US006791079B2

(12) United States Patent
Glukhoy

(10) Patent No.: US 6,791,079 B2
(45) Date of Patent: Sep. 14, 2004

(54) MASS SPECTROMETER BASED ON THE USE OF QUADRUPOLE LENSES WITH ANGULAR GRADIENT OF THE ELECTROSTATIC FIELD

(76) Inventor: Yuri Glukhoy, 440 Arguello Blvd. #1, San Francisco, CA (US) 94118

( * ) Notice: Subject to any disclaimer, the term of this patent is extended or adjusted under 35 U.S.C. 154(b) by 97 days.

(21) Appl. No.: 10/058,153

(22) Filed: Jan. 29, 2002

(65) Prior Publication Data

US 2003/0141445 A1 Jul. 31, 2003

(51) Int. Cl.[7] ..... B01D 59/44
(52) U.S. Cl. ..... 250/287; 250/289; 250/294
(58) Field of Search ..... 256/287, 289, 256/294, 390.08

(56) References Cited

U.S. PATENT DOCUMENTS

| | | | | |
|---|---|---|---|---|
| 4,625,112 | A | * 11/1986 | Yoshida | 250/287 |
| 5,396,065 | A | 3/1995 | Myerholtz et al. | |
| 5,563,410 | A | * 10/1996 | Mullock | 250/288 |
| 5,614,711 | A | * 3/1997 | Li et al. | 250/287 |
| 5,753,909 | A | 5/1998 | Park et al. | |
| 5,763,875 | A | * 6/1998 | Kaesdorf et al. | 250/287 |
| 6,107,625 | A | 8/2000 | Park | |
| 6,384,410 | B1 | * 5/2002 | Kawato | 250/287 |
| 2001/0054684 | A1 | * 12/2001 | Park | 250/287 |
| 2002/0195557 | A1 | * 12/2002 | Hanson et al. | 250/287 |

OTHER PUBLICATIONS

Reece Roth, vol. 1, Institute of Physics Publishing, Bristol, Philadelphia, 1992, pp. 206–218.

* cited by examiner

*Primary Examiner*—John R. Lee
*Assistant Examiner*—Anthony Quash

(57) ABSTRACT

A mass spectrometer of the present invention is based on the use of quadrupole lenses with angular gradient of the electrostatic field. The device consists of an ion source connected to an ion mass separation chamber that contains a plurality of sequentially arranged electrostatic quadrupole lenses which generate a helical electrostatic field for sending ions along helical trajectories in a direct and return stroke. Scattering of positions of points of return is reduced by means of electrostatic mirrors located at the end of the direct stroke, while ions of different masses perform their return strokes along helical trajectories different from those of the direct strokes due to the use of a magnetic and/or electrostatic mirrors. An ion-electron emitting screen is installed on the path of ions in the reverse stroke, and positions of collision of the ions with the ion-electron emitting screen over time and space are detected with the use of micro-channel plate detectors. Movement of ions along the helical trajectory significantly increases the path of ions through the ion separation chamber and, hence, improves the resolution capacity of the mass spectrometer.

21 Claims, 7 Drawing Sheets

MASS SPECTROMETER BASED ON THE USE OF QUADRUPOLE LENSES WITH ANGULAR GRADIENT OF THE ELECTROSTATIC FIELD

FIELD OF THE INVENTION

The present invention relates to the fields of measurement instruments, in particular to mass spectrometers used for analyses of substances based on results of determination of masses of their ions or spectra of masses.

BACKGROUND OF THE INVENTION

In order to understand the present invention, terminology used in the description, and novelty of the present invention over the prior art, it would be advisable first to explain the general principles of construction and operation of mass spectrometers and their classification.

A mass spectrometer is an instrument for separation of ionized particles (such as atoms, molecules, cluster formations) by their masses, more specifically, by a ratio of ion mass m to its charge. The separation is carried out under the effect of magnetic and electric fields. Furthermore, mass spectrometer is used for determining masses of ions and relative contents of specific ions in a substance, i.e., spectrum of masses.

A typical mass spectrometer consists of the following parts: a system for preparation and introduction of an a substance to be analyzed into the instrument; an ions source where the aforementioned substance is ionized at least partially and where an ion beam is formed; a mass analyzer where the ions are separated in accordance with an m/e ratio, focused, and are emitted from the ion source in various directions within a small space angle; a ion receiver or collector where ion current is measured or converted into an electrical signal; and a device for amplification and registration of the output signal. In addition to amount of ions (ion current), the registration unit also receives information about ion mass. Other units included into a mass spectrometer are power supplies, measurement instruments, and a vacuum system. The latter is required for maintaining the interior of the mass spectrometer under high vacuum, e.g. of about $10^{-3}$ to $10^{-7}$ Pa. Operation is normally controlled by a computer, which also stores the acquired data.

A mass spectrometer is characterized by its resolution capacity, sensitivity, response, and a range of measured masses. The aforementioned response is a minimal time required for registration of mass spectrum without the loss of information within the limits of so-called decade of atomic mass units (1–10, 10–100, etc.). Normally such time is 0.1 to 0.5 sec. for static mass spectrometers and $10^{-3}$ for dynamic (time-of-flight) mass spectrometers.

A substance to be analyzed is introduced into the mass spectrometer with the use of so-called molecular or viscous flow regulators, load ports, etc.

By methods of ionization, ion sources of mass spectrometers can be divided into various categories, which are the following: 1) ionization caused by collisions with electrons; 2) photo-ionization; 3) chemical ionization due to ionic-molecular reactions; 4) field ion emission ionization in a strong electric field; 5) ionization due to collisions with ions; 6)atomic-ionization emission due to collisions with fast atoms; 7) surface ionization; 8) spark discharge in vacuum; 9) desorption of ions under effect of laser radiation, electron beam, or products of decomposition of heavy nuclei; and 10) extraction from plasma.

In addition to ionization, in mass spectrometer an ion source is used also for forming and focusing an ion beam.

More detail general information about types and constructions of ion sources suitable for use in mass spectrometers can be found in "Industrial Plasma Engineering" by Reece Roth, Vol. 1, Institute of Physics Publishing, Bristol and Philadelphia, 1992, pp. 206–218.

By types of analyzers, mass spectrometers can be divided into static and dynamic. Static mass spectrometers are based on the use of electric and magnetic fields which remain, during the flight of ions through the chamber, practically unchanged. Depending on the value of the m/e ratio, the ions move along different trajectories.

The most popular static mass spectrometer is a conventional mass spectrograph in which ion beams with different e/m ratios are focused in different areas of a photo-sensitive element, e.g., a photo-sensitive plate located in a focal plane of the instrument. Since the outlet opening of the ion source is made in the form of a slit, after development, the points hit by ions are seen on such a plate in the form of strips. In a static mass spectrometer the ion beam is focused onto the slit of the ion receiver. If the electric or magnetic field varies smoothly, the ion beams with different e/m ratios will sequentially pass through the aforementioned slit. Continuous registration of the ion current will produce a graph with ion peaks on the mass spectrum. If necessary, the obtained mass spectrum can be used for quantitative evaluation by methods of photometry.

In a static mass spectrometer with a homogeneous magnetic field, ions are emitted from the ion-source slit in the form of a diverging beam. When the diverging beam enters the magnetic field, it is divided into beams with different elm ratios. Such beam can be registered on a photo-sensitive plate or in any other registering device. Static mass spectrometers, in turn, can be divided into various types such as static mass spectrometers with a non-homogeneous magnetic field, with ion prisms that separate the beam into sub-beams with different elm ratios, and with double-focusing of the ion beam. Various combinations of the aforementioned mass spectrometers are also possible.

It should be noted that static mass spectrometers are static installations which are heavy in weight, complicated in construction, an operation with them require the use of skilled personnel.

In dynamic mass spectrometers, the ions are separated on the basis of different times of flights through the given distance. Furthermore, the ions can be separated under the effect of pulse or RF electromagnetic fields with periods equal to or shorter than the time of flight of ions through the analyzer. Among the dynamic mass spectrometers, most popular ones are time-of-flight types, RF types, quadrupole types, magnetic-resonance type, and ion-cyclotron resonance types of mass spectrometers.

In time-of-flight mass spectrometers, ions formed in the ion source are injected into the analyzer via a grid in the form of short pulses of ion current. The analyzer comprises an equipotential space. On its way to the collector, the pulse is decomposed into several sub-pulses of the ion current. Each such sub-pulse consists of ions with the same elm ratios. The aforementioned decomposition occurs because in the initial pulse all ions have equal energies, while the speed of flight V and, hence, the time of flight t through the analyzer with the length equal to I are inversely proportional to $m^{1/2}$:

$$T=I(m/2eV)^{1/2}.$$

A series of pulses with different e/m ratios forms a mass spectrum that can be registered, e.g., with the use of an oscilloscope. Resolution capacity of such an instrument is proportional to length l.

An alternative version of the time-of-flight mass spectrometer is a so-called mass-reflectron, which allows an increase in resolution capacity due to the use of an electrostatic mirror.

Energies of ions collected in each packet are spread over the temperature of the initial gas. This leads to broadening of peaks on the collector. Such broadening is compensated by the electrostatic mirror that prolongs the time of flight for slow ions and shortens the time of flight for fast ions. With the drift path being the same, the resolution capacity of a mass reflectron is several times the resolution capacity of a conventional time-of-flight mass spectrometer.

In the ion source of an RF mass spectrometer, ions acquire energy eV and pass through a system of several stages arranged in series. Each stage consists of three spaced parallel grids. An RF voltage is applied to the intermediate grid. With the frequency of the applied RF field and energies eV being constant, only those ions can pass through the space between the first and intermediate grids that have a predetermined m/e ratio. The remaining ions are either retarded or acquire only insignificant energies and are repelled from the collected by means of a special decelerating electrode. Thus, only ions with the selected m/e ratio reach the collector. Therefore, in order to reset the mass spectrometer for registration of ions with a different mass, it is necessary either to change the initial energy of ion beam, or frequency of the RF field.

In a quadrupole mass spectrometer, ions are spatially redistributed in a transverse electric field with a hyperbolic distribution of the electric potential. This field is generated by a quadrupole capacitor having a d.c. voltage and RF voltage applied between pairs of rods. The ion beam is introduced into a vacuum chamber of the analyzer in the axial direction of the capacitor via an input opening. With the frequency and amplitude of the RF field being the same, only ions with a predetermined m/e ratio will have the amplitude of oscillations in the transverse direction of the analyzer shorter than the distances between the rods. Under the effect of its initial velocity, such ions will pass through the analyzer and will be registered and reach the collector, while all other ions will be neutralized on the rods and pumped out from the analyzer. Reset of such mass spectrometer to ions of another mass will require to change ether the amplitude or the frequency of the RF voltage. Quadrupole mass spectrometers have resolution capacity of about $10^3$.

Magnetic resonance mass analyzers are based on the fact that the time required for ions to fly over a circular trajectory will depend on the ion mass. In such mass analyzers, resolution capacity reaches $2.5\times10^4$.

The last group relates to ion-cyclotron resonance mass spectrometers in which electromagnetic energy is consumed by ions, when cyclotron frequency of the ions coincides with the frequency of the alternating magnetic field in the analyzer. The ions move in a homogeneous magnetic field B along a spiral path with so-called cyclotron frequency $$\omega_c = eB/mc,$$

where c is velocity of light. At the end of their trajectory, the ions enter the collector. Only those ions reach the collector, the cyclotron frequency of which coincides with that of the alternating electric field in the analyzer. It is understood that selection of ions is carried out by changing the value of the magnetic field or of the frequency of the electromagnetic field. Ion-cyclotron resonance mass spectrometers ensure the highest resolution capacity. However, mass spectrometers of this type require the use of very high magnetic fields of high homogeneity, e.g., of 10 Tesla or higher. In other words, the system requires the use of super-conductive magnets which are expensive in cost and large in size.

Attempts have been made to improve existing mass spectrometers of the time-of-flight type, e.g., by improving ion storage devices, introducing deflectors for selection of ions for analysis in a mass spectrometer, reorganizing sequencing of ion packets or by extending the time of flight for improving resolution capacity of the mass spectrometers.

For example, U.S. Pat. No. 5,396,065 issued in 1995 to C. Myerholtz, et al. discloses an encoded sequence of ions in packets for use in time-of-flight mass spectrometers, in which the high-mass ions of a leading packet will be passed by the low-mass ions of a trailing packet. Thus, a high efficiency time-of-flight mass spectrometer is formed. The ions of each packet are acted upon to bunch the ions of the packet, thereby compensating for initial space and/or velocity distributions of ions in the launching of the packet. The times of arrival of the ions are determined at the detector to obtain a signal of overlapping spectra corresponding to the overlapping launched packets. A correlation between the overlapping spectra and the encoded launch sequence is employed to derive a single non-overlapped spectrum.

However, such method and apparatus makes interpretation of obtained data more complicated and not easily comprehensible. Furthermore, addition electronic circuits are required for control of the ion packet sequence.

U.S. Pat. No. 5,753,909 issued in 1998 to M. Park et al. describes a method and apparatus for analyzing ions by determining times of flight including using a collision cell to activate ions toward fragmentation and a deflector to direct ions away from their otherwise intended or parallel course. Deflectors are used as gates, so that particular ions may be selected for deflection, while others are allowed to continue along their parallel or otherwise straight path, from the ion source, through a flight tube, and eventually, to a detector. A postselector, in the form of two deflection plates is used as an ion deflector and is encountered by ions after the collision cell as they progress through the spectrometer.

A disadvantage of the device disclosed in U.S. Pat. No. 5,753,909 consists in that this mass spectrometers is based on the selection of specific ions and does not show the entire mass spectrum. For obtaining the entire spectrum, it is necessary to perform step by step scanning, and this requires an additional time.

U.S. Pat. No. 6,107,625 issued in 2000 to M. Park discloses a coaxial multiple reflection time-of-flight mass spectrometer of a time-of-flight type with resolution capacity improved due to a longer time of flight of the ions. The apparatus comprises two or more electrostatic reflectors positioned coaxially with respect to one another such that ions generated by an ion source can be reflected back and forth between them. The first reflecting device is an ion accelerator which functions as both an accelerating device to provide the initial acceleration to the ions, and a reflecting device to reflect the ions in the subsequent mass analysis. The second reflecting device is a reflectron which functions only to reflect the ions in the mass analysis. During the mass analysis, the ions are reflected back and forth between the accelerator and reflectron multiple times. Then, at the end of the ion analysis, either of the reflecting devices, preferably the ion accelerator, is rapidly deenergized to allow the ions to pass through that reflecting device and into a detector. By reflecting the ions back and forth between the accelerator and reflectron several times, a much longer flight path can be achieved in a given size spectrometer than could otherwise be achieved using the time-of-flight mass spectrometers disclosed in the prior art. Consequently, the mass resolving power of the time-of-flight mass spectrometer is substantially increased.

This is a typical system with storage of ions which does not allow a continuous mode of mass analysis since it requires period de-energization of one of the reflecting device. Obviously, the data is difficult to interpret, especially when masses of ions are scattered in a wide range so that light ions may undergo several reflection while heavy ions made only one or two reflections.

Thus, the existing mass spectrometers are either possess high performance characteristics at the expense of high cost and large dimensions, or are small in size, simple in construction, and inexpensive at the expense of the loss in resolution capacity and performance characteristics. None of the existing mass spectrometers combine in themselves such features as a reasonable cost, high performance characteristics, simple construction, and high resolution capacity.

OBJECTS AND SUMMARY OF THE INVENTION

It is an object of the present invention to provide a mass spectrometer that combines in itself such features as a reasonable cost, high performance characteristics, simple construction, and high resolution capacity. Another object is to provide a method of mass analyses, which allows to improve sensitivity and resolution capacity of a mass spectrometer. Another object is to provide a mass spectrometer operating in real time with convenient presentation of data for analysis. Still another object is to provide a mass spectrometer that combines advantages of dynamic time-of-flight systems with those of static mass spectrometers.

A mass spectrometer of the present invention is based on the use of quadrupole lenses with angular gradient of the electrostatic field. The device consists of an ion source connected to an ion mass separation chamber that contains a plurality of sequentially arranged coaxial electrostatic quadrupole lenses which generate a helical electrostatic field for sending ions along helical trajectories in a direct and return stroke. Scattering of positions of points of return is reduced by means of electrostatic mirrors located at the end of the direct stroke, while ions of different masses perform their return strokes along helical trajectories different from those of the direct strokes due to the use of a magnetic and/or electrostatic mirrors. An ion-electron emitting screen is installed on the path of ions in the reverse stroke, and positions of collision of the ions with the ion-electron emitting screen over time and space are detected with the use of micro-channel plate detectors. Movement of ions along the helical trajectory significantly increases the path of ions through the ion separation chamber and, hence, improves the resolution capacity of the mass spectrometer.

DETAILED DESCRIPTION OF THE INVENION

FIGS. 1–6. Construction of Mass Spectrometer of the Invention

Figure 1:
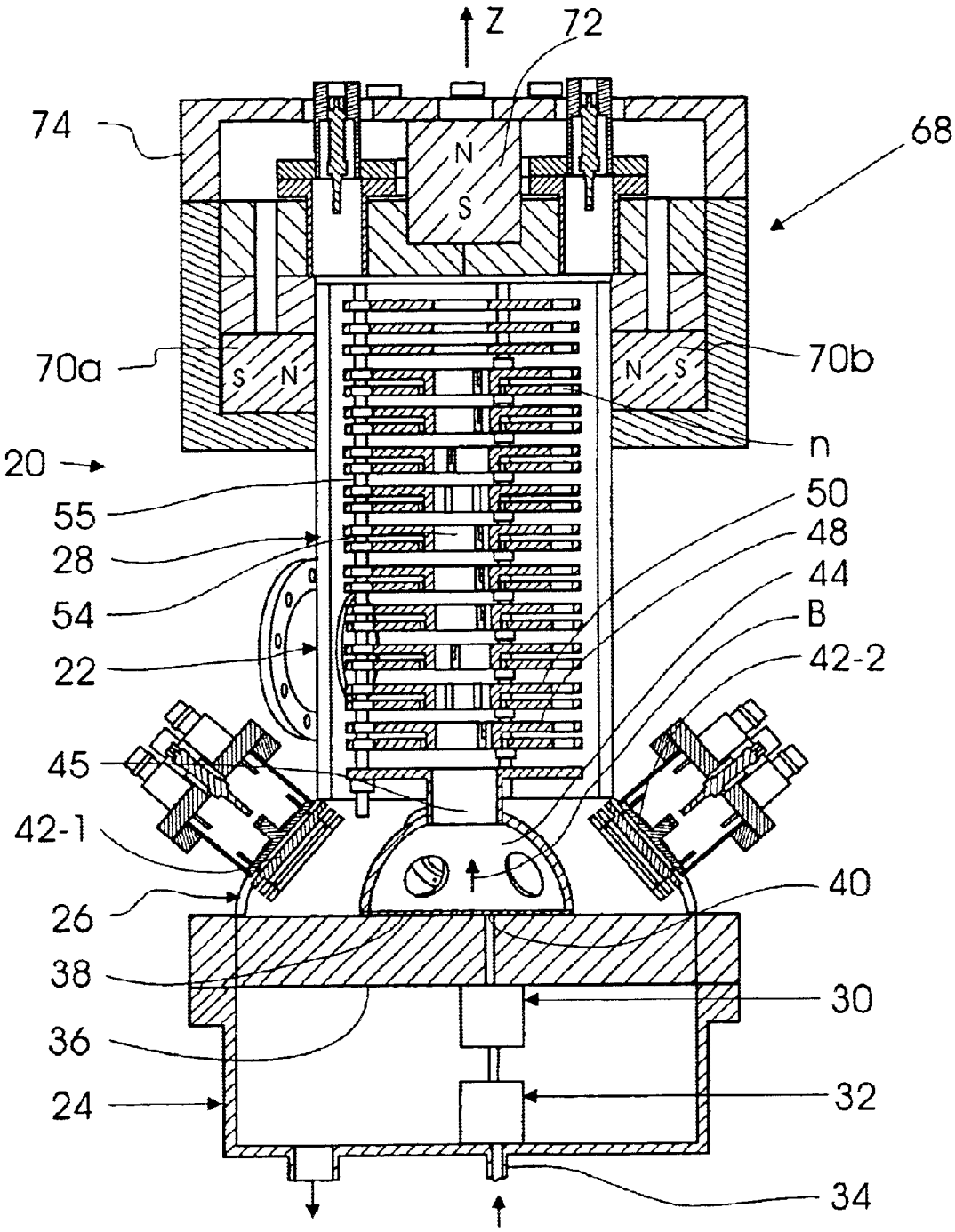
FIG. 1 is a longitudinal sectional view of the mass spectrometer of the invention.

A mass spectrometer of the present invention, which is general is designated by reference numeral 20, is shown in FIG. 1, which is a longitudinal sectional view of the mass spectrometer 20. The mass spectrometer 20 has a sealed housing 22 that consists of a ion-source chamber 24, an analyzer chamber 26, and an ions separation chamber 28. All three chambers are connected in sequence in the injection direction of ions.

The ion-source chamber 24 contains an ion source 30, a gas flow regulator 32 connected to the exit of the ion source 30, and a gas-supply tube 34 connected to the input of the ion source 30. The ion source 30 may of any suitable type such as those mentioned above, i.e., electron-collision type, photo-ionization type, field ion emission ionization type, atomic-ionization emission type, spark-discharge type, ion extraction type, etc.

The ion source 30 is connected to the analyzer chamber 26 via an adapter plate 36 that supports an ion-electron emission screen 38 having an ion-injection aperture 40.

The analyzer chamber 26 contains a number of micro-channel plate detectors 42-1, 42-2 . . . which, as shown in FIG. 1, are arranged circumferentially at equal distances from each other around the analyzer chamber and extend radially inwardly into this chamber from the outer side of the mass spectrometer 20 and toward a semi-spherical casing 44 that rests on the adapter plate 36 and covers the ion-electron emission screen 38. It should be noted that the longitudinal axis of the semi-spherical casing 44 is offset with respect to the direction of emission of the ions from the ion source. The purpose and operation of the micro-channel plate detectors will be explained later.

Figure 2:
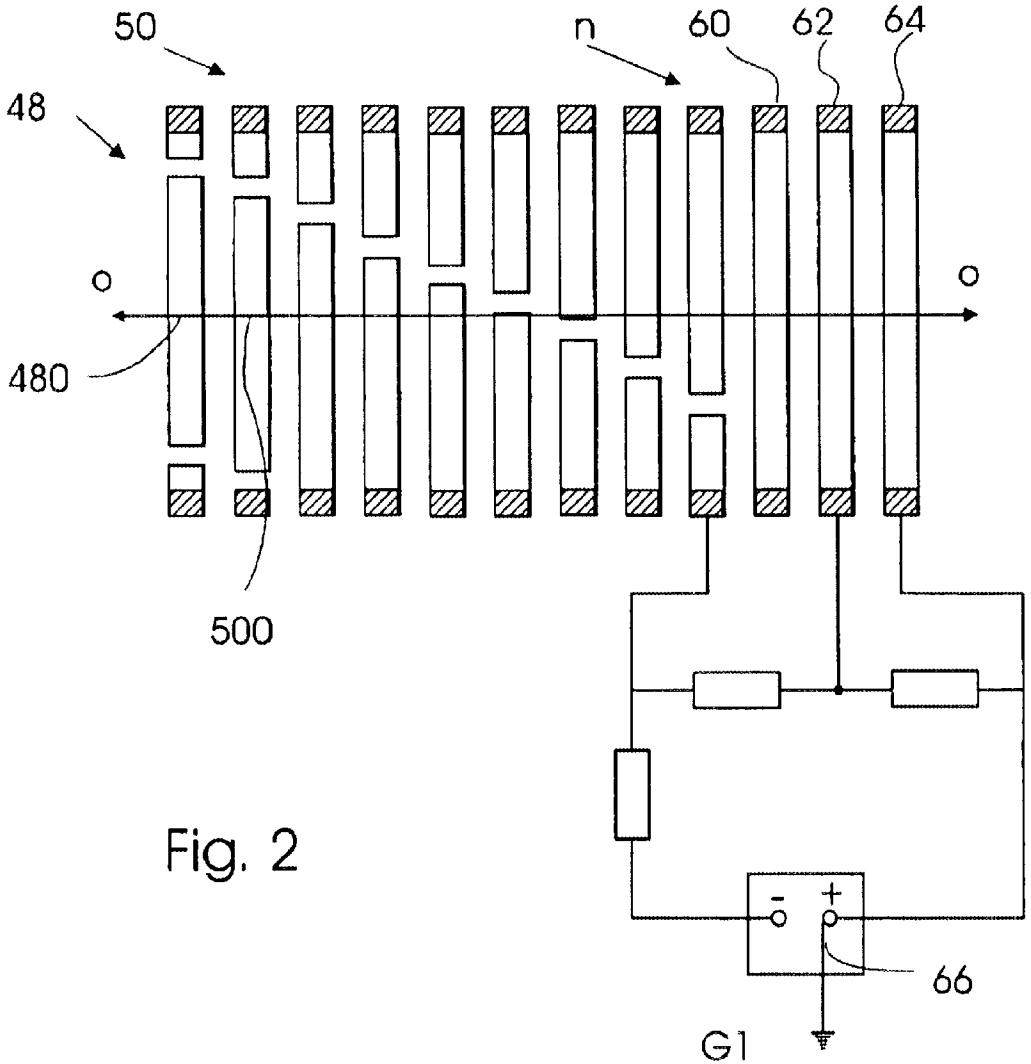
FIG. 2 is an axial sectional view of the electrostatic lens assembly composed of the a plurality of electrostatic quadrupole lenses arranged in series.
Figure 3:
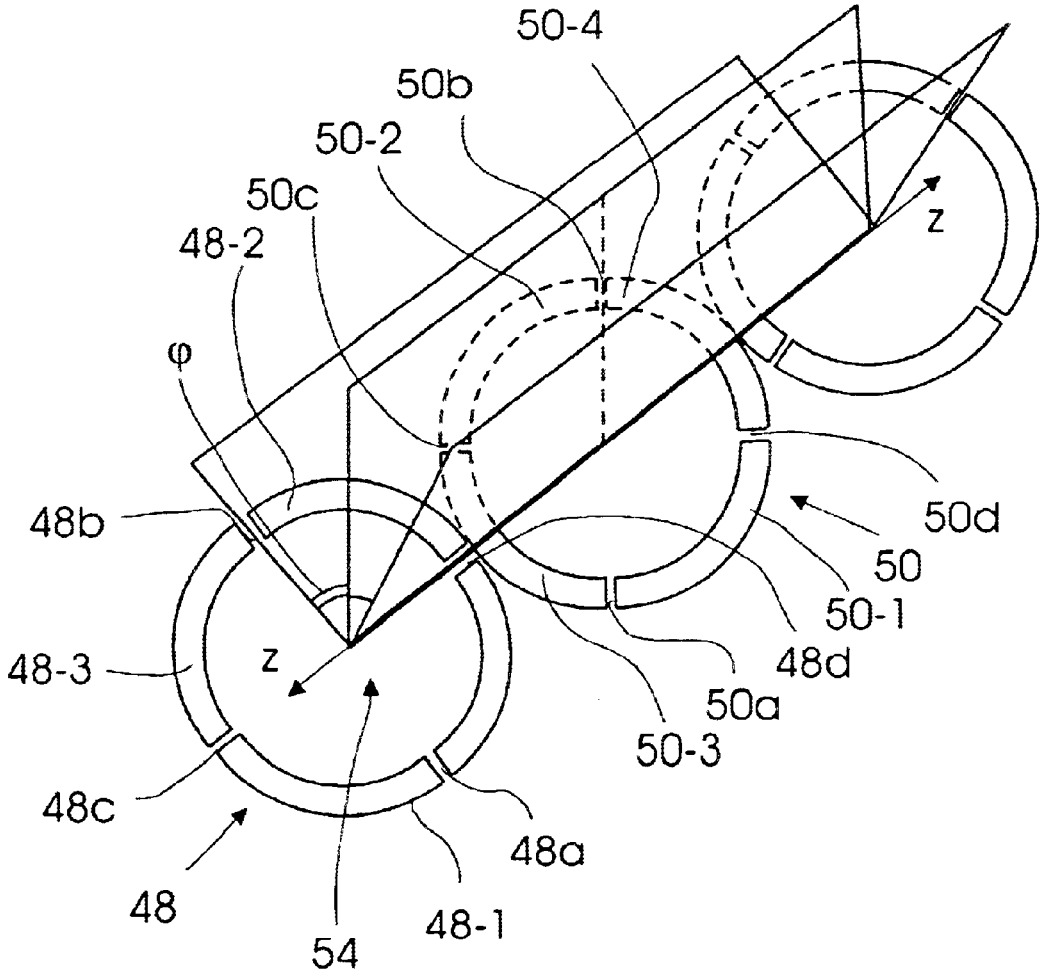
FIG. 3 is a three-dimensional view of three sequential quadrupole lenses illustrating angular shift of the poles.

The ion separation chamber 28 contains a series of sequentially arranged quadrupole electrostatic lenses 48, 50, . . . . n. FIG. 2 is an axial sectional view of the electrostatic lens assembly composed of the aforementioned lenses 48, 50, . . . n, and FIG. 3 is a three-dimensional view of three sequential quadrupole lenses illustrating angular shift of the poles. The assembly shown in FIG. 2 consists of nine lenses, which are shown in this quantity only as an example. As can be seen from FIGS. 2 and 3, each lens consists of four equally-spaced arch-shaped poles. More specifically, the quadrupole lens 48 consists of poles 48-1, 48-2, 48-3, and 48-4, the quadrupole lens 50 consists of four equally-spaced arch-shaped poles 50-1, 50-2, 50-3, and 50-4, the quadrupole lens 52 consists of four equally-spaced arch-shaped poles 52-1, 52-2, 52-3, and 52-4, etc. (other lenses are nor shown). Each lens has a central opening, so that in combination these openings form a central ion-guiding channel 54. In each circular quadrupole lens, the poles are separated in the circumferential direction by gaps, i.e., by gaps 48*a*, 48*b*, 48*c*, and 48*d* in the quadrupole lens 48, by gaps 50*a*, 50*b*, 50*c*, and 50*d* in the quadrupole lens 50, etc.

As can be seen from FIGS. 2 and 3, the quadrupole lenses of the assembly are shifted angularly with respect to each other to an angle equal to 360° divided by the number of the circular lenses in the assembly. In the embodiment of the mass spectrometer shown in FIGS. 1–3, the angular shift of the poles and gaps of each sequential circular quadrupole lens with respect to the preceding lens is equal to 360°/9= 40°. It is understood that these numbers are given only as an example and that the number of circular quadrupole lenses and hence the angular shift could be different.

The purpose of the aforementioned angular shift between the poles of the sequential quadrupole lenses 48, 50, . . . n is to create specific electrostatic quadrupole fields in axial spaces between the planes of the adjacent lenses. These gradient fields are arranged along the ion-guiding channel 54 in the direction of propagation of ions emitted from the ions source 30 (FIG. 1), i.e., along the longitudinal axis Z (FIGS. 1 and 3). The aforementioned electrostatic quadrupole fields are characterized by an angular gradient with the angle measured in planes perpendicular to the axis Z or parallel to the planes of the lenses. In combination, the aforementioned specific electrostatic quadrupole fields can be considered as a single helical electrostatic quadrupole field.

Figure 4:
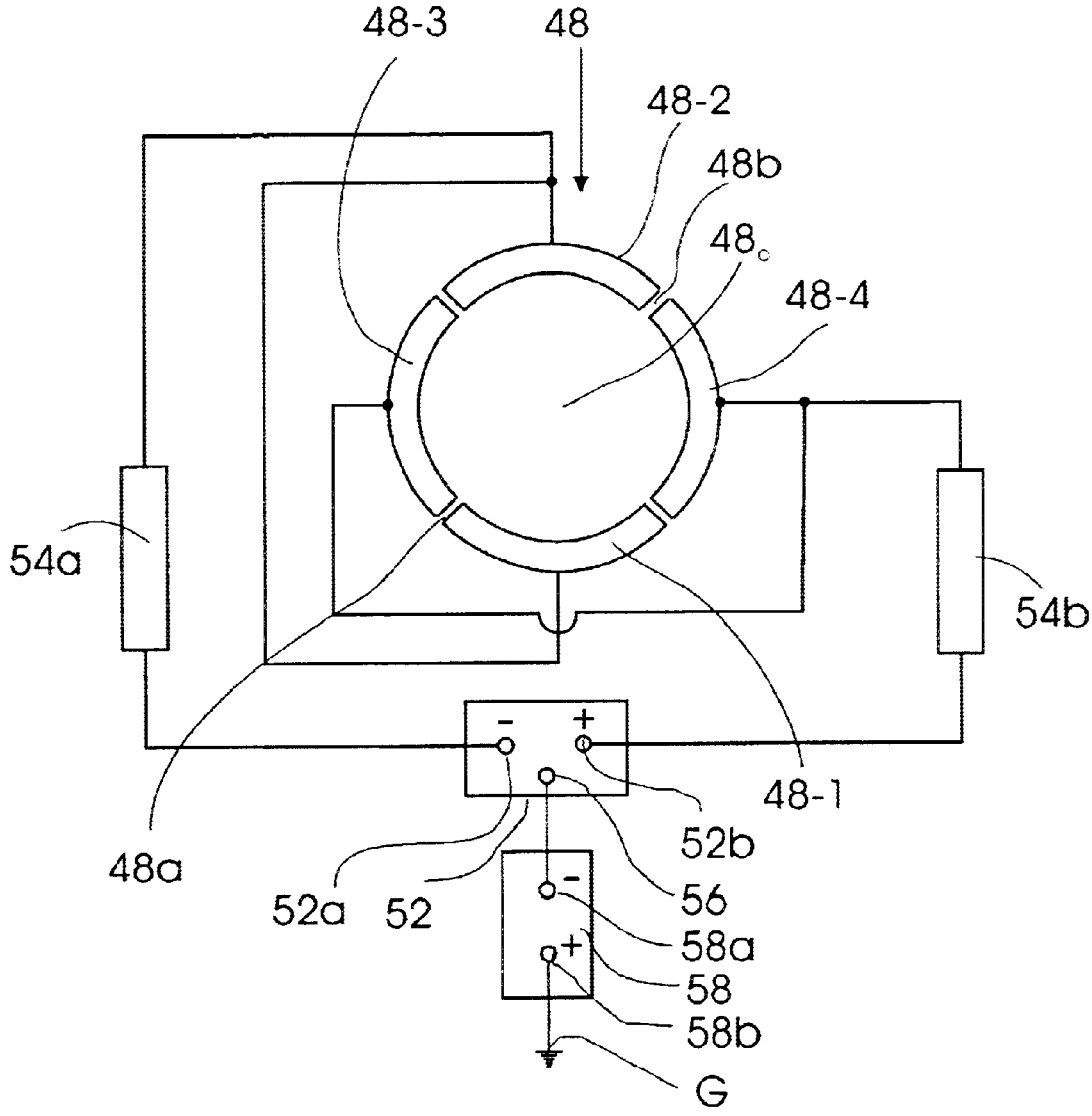
FIG. 4 is an electric circuit illustrating application of electric potentials to the poles of one of the circular electrostatic quadrupole lenses.

The aforementioned helical electrostatic quadrupole field can be realized with an application of respective electric potentials to the poles of the sequential circular quadrupole lenses. FIG. 4 is an electric circuit illustrating application of electric potentials to the poles of one of the circular electrostatic quadrupole lenses, e.g., the lens 48. As can be seen from FIG. 4, the lens 48, as well as any other lens of the assembly, consists of two pairs of diametrically opposite poles receiving equal potential. Thus, in FIG. 4, the first pair consists of the poles 48-1 and 48-2 connected to a negative terminal 52*a*, while the second pair consists of the poles 48-3 and 48-4 connected to a positive terminal 52*b* of a power source 52. Each pair the poles is connected to the respective terminal via an electric resistor, i.e., a resistor 54*a* for the poles 48-1 and 48-2, and a resistor 54*b* for the poles 48-3 and 48-4. In the example shown in FIG. 4, the power source 52 has −20V on its negative terminal 52*a* and +20V on the positive terminal 52*b*. The midpoint 56 of the power source 52 is connected to a negative terminal 58*a* of a high-voltage power source 58, the positive terminal 58*b* of which is grounded at G. In the embodiment shown in FIG. 4, the terminal 58*a* of the high-voltage power source 58 has a potential of −4.5 kV.

Each successive circular quadrupole lens of the lens assembly has the potential application circuit the same as the one shown in FIG. 4, with the exception that the poles are angularly shifted by angle equal to 360° divided by the number of the circular lenses in the assembly. In the embodiment of the invention shown in FIGS. 1–4 with nine lenses, the shift angle will be equal to 40°. Another distinction of the circuits in the sequential lenses is that the potential on the negative terminals (that correspond to the terminal 58*a* of the source 58 in FIG. 4), will be reduced in each lens by 500V in the direction of propagation of the ions. Thus, if the first lens 48 has on the terminal 58*a* of the high-voltage source 58 a negative potential of −4.5 kV, then in the second lens 50 a respective terminal will have a potential equal to −4 kV, etc. More specifically, the central point (such as point $\mathbf{48}_0$ of the lens 48 shown in FIG. 4) will have a potential equal to −4.5 kV in the lens 48, −4 kV in the lens 50, −3.5 kV in the next lens, and finally, the lens n will have a potential equal to 0.

Figure 5:
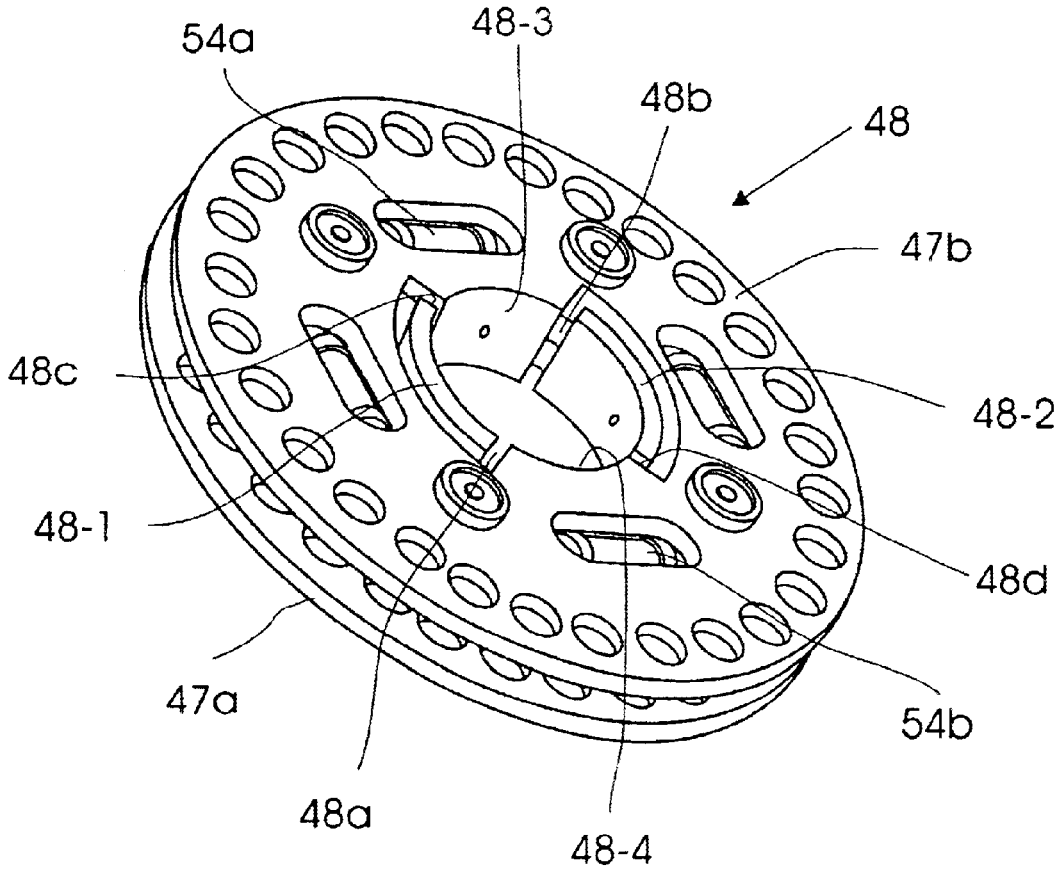
FIG. 5 is a three-dimensional view illustrating the construction of one of the electrostatic quadrupole lenses.
Figure 6:
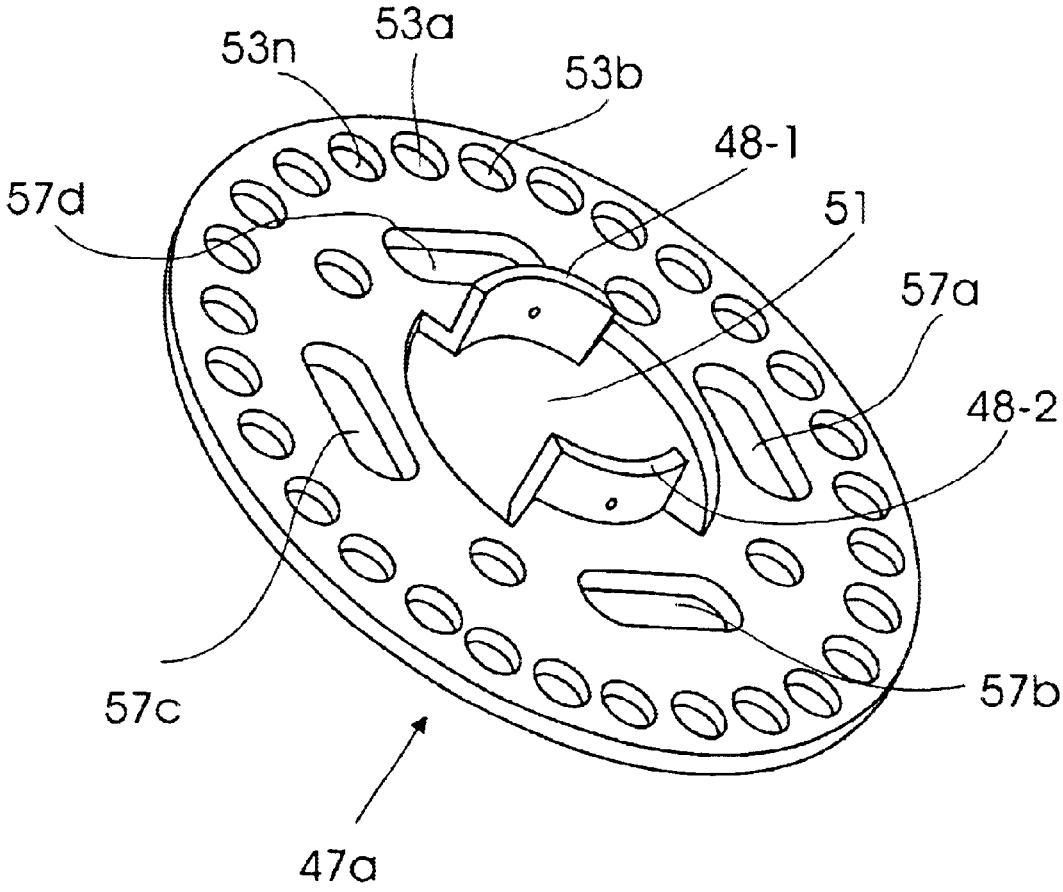
FIG. 6 is a three-dimensional view of one of component disks from which the quadrupole lenses are assembled.

FIG. 5 is a three-dimensional view illustrating the construction of one of the electrostatic quadrupole lenses, e.g., the lens 48. FIG. 6 is a three-dimensional view of one of component disks from which the lens 48 is assembled. More specifically, it is advantageous to assembly each electrostatic quadrupole lens from two identical disks 47*a* and 47*b* (only one of these disks, i.e., the disk 47*a* is shown in FIG. 6). The disk 47*a* has a central opening 51 with two diametrically opposite arch-shaped axial projections, that will be used as poles 48-1 and 48-2. Openings 53*a*, 53*b*, . . . 53*n* are needed for assembling and of the electrostatic quadrupole lenses within the ion separation chamber 28 by means of dielectric, e.g., ceramic, rods (only one of these rods 55 is shown in FIG. 1 in order to simplify the drawing). Oval windows 57*a*, 57*b*, 57*c*, and 57*d* are used for accommodation of resistors 54*a*, 54*b* (FIG. 4). As shown in FIG. 5, the lens 48 is easily formed by imposing the disk 47*a* onto the disk 47*b* in mirror positions of both disks and with angular shift of projections 48-1, 48-2 of disk 47*a* relative to the projections 48-3 and 48-4 by 90°. The disks are isolated from each other by ceramic spacers (not shown). In FIG. 6, reference numerals 48*a*, 48*b*, 48*c*, and 48*d* designate the respective gaps shown in FIG. 3, and reference numeral 54*a* and 54*b* designate electric resistors.

In each lens the absolute value of the potential difference between each pair of diametrically opposite poles is equal to 40 V (i.e., [−20V+(−20V)]. Furthermore, in each subsequent lens in the direction of propagation of the ions the potential in the center of the lens will be reduced. It is well known that in an electric field charges particles move in the direction of the field gradient. Therefore in the aforementioned helical electrostatic quadrupole field, the ions will move along helical trajectories. Such trajectories are well known for movement of electrons in electron cyclotron resonance (ECR) as well as in the Penning plasma. However, in ECR and in the Penning plasma, the aforementioned helical movement of electrons has an entirely different physical nature and is caused by the drift of the charge in a magnetic field. In the of our invention, however, the helical trajectory of positively-charged ions results from a specific structure of the electric field in the absence of the magnetic field. Therefore, the aforementioned helical movements should not be confused.

Since the potential on the first lens 48 is negative, on its way in the propagation direction the positively-charged ion will be first accelerated by being attracted due to the negative potential on the lens 48. Such acceleration will be continued for a predetermined point on the path of the ion. However, in the course of its continuing movement, the ion will experience the pulling force developed by negative potentials of those lenses which are left behind the ion. These forces will pull the ion back towards the ion source 30 and thus will gradually decelerate the ion. It also should be noted that the forces acting on all ions will be the same for equally-charged ions. However, since ions of different substances have different masses, those ions which have low masses will fly through the ion separation chamber 28 for a shorter time than those ion that are heavier. This is the so-called time-of-flight principle used for identification of ions in time-of-flight type mass spectrometers. As has been described earlier in the review of the prior art technique, it is also known that resolution capacity of time-of-flight mass spectrometers is directly proportional to the length of the trajectory of ions in the analyzer (in our case, in the ion separation chamber 28). Therefore, by causing the ions to move along the helical trajectory, it becomes possible to significantly increase the path of ions through the ion separation chamber 28 and to correspondingly increase the resolution capacity of the mass spectrometer 20.

Figure 7:
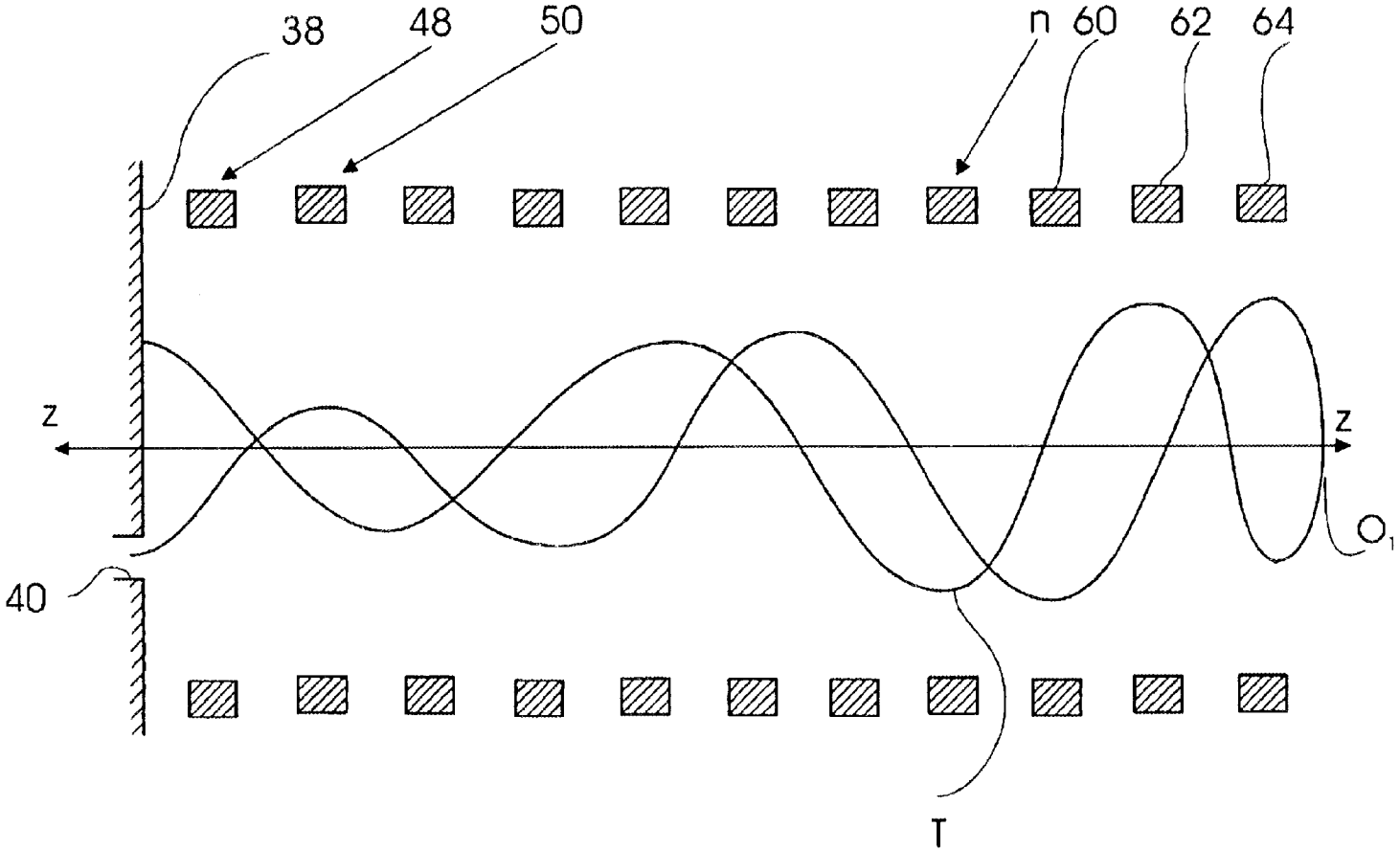
FIG. 7 illustrates one possible trajectory of an ion at a specific distribution of the electrostatic potentials on the electrostatic lenses of the mass spectrometer of the invention.

FIG. 7 illustrates one possible trajectory of an ion at a specific distribution of the electrostatic potentials on the electrostatic lenses of the mass spectrometer 20 of the invention. On its way in the direction of propagation the ion reaches a point $\mathbf{0}_1$ in which its velocity in the Z-axis direction becomes equal to 0 due to the forces pulling the ion back to the ion source 30 (FIG. 1). In this point of the trajectory the ion reverses its direction and begins to move back towards the ion source 30. In principle, the point of return can be located at a significant distance from the first lens 48, especially for light ions. Therefore, in order to enhance the retardation force, the ion separation chamber 28 is provided with electrostatic mirrors 60, 62, and 64 (FIGS. 1, 2, 7) coaxial with the quadrupole lenses 48, 50, . . . n and arranged after the n-th lens in the ion propagation direction. Each such mirror comprises a continuous ring with a positive potential applied from a power source 66. The mirrors 60, 62, 64 are provided with a potential adjustment means, e.g., by adjusting the voltage on the power source 66. A separate adjustment circuit may be used. The electrostatic mirrors reduce scattering of the aforementioned points of return.

In addition to the aforementioned electrostatic mirrors 60, 62, 64, the ion separation chamber 28 may be equipped with a magnetic mirror 68 (FIG. 1) that consists of a permanent magnets arranged circumferentially around the distal end of the ion separation chamber 28 (only two of these magnets, i.e., 70*a*, and 70*b* are seen in FIG. 1) and a permanent magnet 72 at the end face and inside the distal end of the ion separation chamber 28. The magnets 70*a*, 70*b*, . . . and 72 are surrounded by a magnetic guide body 74, so that magnetic force lines have a diverging pattern in the area of the aforementioned points of return of the ions where they change the direction of their movement. It is known that when an ion enters a magnetic fields, it begins to drift in this field with the drift in the direction perpendicular to the ion velocity direction and to the direction of the line of forcers of the magnetic field. The drift velocity is inversely proportional to masses of ions. Therefore, points of return will be different for ions of different masses, and the helical return trajectories for ions of different masses will be different as well. If the aforementioned magnetic field is absent, the ions will return towards the ion-electron emission screen along the same helical trajectories as on their direct way. In other words, in planes perpendicular to the direction of ion propagation the magnetic mirror scatters ions of different mass in order to prevent them from returning along the same trajectories in which they traveled in the direct section of their path.

Thus, on their return paths, depending on their masses, the ions of the same ion beam current pulse will hit the ion-electron emission screen 38 in different points of the screen 38 and at different times. As shown in FIG. 1, the ion-electron emission screen 38 is covered by the semi-spherical casing 44 that rests on the adapter plate 36. The ions incident on the ion-electron emission screen 38 knock out electrons from the ion-electron emission screen 38. These secondary-emission electrons move in the directions determined by a cosine law with respect to the direction of incidence of the ions. The direction of incidence of the ions is confined within the aperture 45 of the casing 44 (FIG. 1). Therefore, a majority of electrons of secondary emission will be concentrated within a solid angle of 15° to 60° to the normal, i.e., to axis Z. In other words, irrespective of the point of incidence of ions and, hence, the points of electron emission, almost all electrons will be within the area affected by the micro-channel plate detectors 42-1, 42-2 . . . shown in FIG. 1. The micro-channel plate detectors 42-1, 42-2 . . . suitable for the purposes of the present invention are products of . . . The micro-channel plate detectors 42-1, 42-2 . . . are capable of detecting points and times of collision of the ions with the ion-electron emission screen 38. Detection of collision time is possible due to extremely high resolution capacity of these devices. In other words, the mass spectrometer 20 of the present embodiment makes it possible to separate ions of different masses over time and space. Thus, the mass spectrometer of the invention combines advantages of dynamic time-of-flight systems with those of static mass spectrometers.

FIGS. 1–4—Operation of the Mass Spectrometer of the Invention

In operation, the ion source 30 injects the ions of the substance being analyzed into the mass separation chamber 28 through the analyzer chamber 26 that contains a series of the quadrupole electrostatic lenses 48, 50, . . . n. Since the direction of injection of ions (arrow B in FIG. 1) is offset with respect to the longitudinal axis Z, the ions are subjected to the effect of several forces, such as force of attraction developed by negatively-charged poles of the lenses located ahead of the ions and dragging forces pulling the ions back towards the ion source 30 developed by negatively-charged poles of the lenses located behind the ions. Under effect of these forces and due to angular shift of poles that develops an electric field with angular gradient in sequentially arranged quadrupole electrostatic lenses 48, 50, . . . n, the ions begin to move along the aforementioned helical trajectories. Since the ions move in the propagation direction with deceleration, their radii on the helical trajectories are not constant and gradually increase. The lighter ions move with higher velocities than heavier ions. In other words, the ions are separated according to a conventional time-of-flight separation process, but along the helical rather than linear trajectories. The aforementioned helical electrostatic quadrupole field is developed due to application of respective electric potentials to the poles of the sequential circular quadrupole lenses. An example of a helical trajectory T described by an ion on the direct and return paths is shown in the aforementioned FIG. 7.

Since the potential on the first lens 48 is negative, on its way in the propagation direction the positively-charged ion will be first accelerated by being attracted due to the negative potential on the lens 48. Such acceleration will be continued for a predetermined point on the path of the ion. However, in the course of its continuing movement, the ion will experience the pulling force developed by negative potentials of those lenses which are left behind the ion. These forces will pull the ion back towards the ion source 30 and thus will gradually decelerate the ion. It also should be noted that the forces acting on all ions will be the same for equally-charged ions. However, since ions of different substances have different masses, those ions which have low masses will fly through the ion separation chamber 28 for a shorter time than those ion that are heavier. As has been described earlier in the review of the prior art technique, it is also known that resolution capacity of time-of-flight mass spectrometers is directly proportional to the length of the trajectory of ions in the analyzer (in our case, in the ion separation chamber 28). Therefore, by causing the ions to move along the helical trajectory, it becomes possible to significantly increase the path of ions through the ion separation chamber 28 and to correspondingly increase the resolution capacity of the mass spectrometer 20.

On its way in the direction of propagation the ion reaches a point in which its velocity becomes equal to 0 due to the forces pulling the ion back to the ion source 30. In this point of the trajectory the ion reverses its direction and begins to move back towards the ion source 30. The retardation action is enhanced in the ion separation chamber 28 by electrostatic mirrors 60, 62, and 64. If necessary, the potential on the mirrors can be adjusted. Further the ions are subjected to the action of the magnetic mirror 68 composed of the 70*a*, 70*b*, . . . and 72 which change the direction of movement of ions. When ions enter the magnetic field, they begin to drift in the direction perpendicular to the ion velocity vector and to the direction of the line of forces of the magnetic field. The drift velocity is inversely proportional to masses of ions. Therefore, points of return will be different for ions of different masses, and the helical return trajectories for ions of different masses will different. If the aforementioned magnetic field would be absent, the ions would have returned towards the ion-electron emission screen along the same helical trajectories as on their direct way.

Thus, on their return paths, depending on their masses, the ions of the same packet will hit the ion-electron emission screen 38 in different points of the screen 38 and at different times. The ions incident on the ion-electron emission screen 38 knock out electrons from the ion-electron emission screen 38. These secondary-emission electrons move in the directions determined by a cosine law with respect to the direction of incidence of the ions. The direction of incidence of the ions is confined within the aperture 45 of the casing 44 (FIG. 1). Therefore, a majority of electrons of secondary emission will be concentrated within a solid angle of 15° to 60° to the normal, i.e., to axis Z. In other words, irrespective of the point of incidence of ions and, hence, the points of electron emission, almost all electrons will be within the area affected by the micro-channel plate detectors 42-1, 42-2 . . . shown in FIG. 1.

Thus, it has been shown that the mass spectrometer of the invention combines advantages of dynamic time-of-flight systems with those of static mass spectrometers. The mass spectrometer of the invention has a reasonable cost, high performance characteristics, simple construction, and high resolution capacity. The mass spectrometer allows has improved sensitivity and resolution capacity. It operates in real time with convenient presentation of data for analysis. It combines advantages of dynamic time-of-flight systems with those of static mass spectrometers.

Although the invention has been shown and described with reference to specific embodiments, it is understood that these embodiments should not be construed as limiting the areas of application of the invention and that any changes and modifications are possible, provided these changes and modifications do not depart from the scope of the attached patent claims. For example, The number of quadrupole electrostatic lenses may be different from nine. The quadrupole lenses in the series can be angularly shifted non necessarily to equal angles. For example, in each subsequent lens the shift angle may be increased. Lenses with angular shift can alternate with lenses without angular shift. The diameter of quadrupole lenses may decrease or increase in the direction of propagation and can be inscribed into a conical surface. The lenses can be axially spaced at difference distances. The mass spectrometer can be used without circular electrostatic mirrors. In general, the circular quadrupole electrostatic lenses can be arranged in such a manner that the lenses will produce the electrostatic field with any given angular gradient so that ions will move along any given spatial trajectory, not necessarily helical.

What is claimed is:

1. A mass spectrometer based on the use of a plurality of quadrupole lenses with angular gradient of the electrostatic field between adjacent quadrupole lens of said plurality, said mass spectrometer comprising:

an ion source with an ion outlet for emission of ions of a substance to be analyzed;

an ion mass separation chamber sealingly connected to said ion source and receiving said ions from said ion source, said ion mass separation chamber having electrostatic field generation means for generating an electrostatic field, said electrostatic field generation means comprising a plurality of quadrupole electrostatic lenses which are arranged in series and coaxially in said direction of propagation and form a central ion-guiding channel for propagation of said ions, each of said quadrupole electrostatic lenses comprising a circular body formed by four arch-shaped poles located substantially in a common plane perpendicular to said longitudinal axis and arranged circumferentially about said longitudinal axis in the form of a first pair composed of two diametrically opposite and electrically connected poles and a second pair composed of two diametrically opposite and electrically connected poles, in each of said quadrupole electrostatic lenses said poles being angularly shifted with respect to said poles of a quadrupole electrostatic lens subsequent in said direction of propagation by a selected angle in order to provide said angular gradient of the electrostatic field between adjacent quadrupole lenses of said plurality and thus to cause said Ions to move along helical trajectories;

mirror means comprising: an electrostatic mirror for reflecting said ions in a reverse direction opposite to said direction of propagation for dividing said helical trajectories into a direct section for movement of said ions in said direction of propagation and a reverse section for movement of said ions in a direction opposite to said direction of propagation; and a magnetic mirror for scattering ions of different mass in order to prevent them from returning along the same helical trajectories in which they traveled in said direct section, said electrostatic mirror and said magnetic mirror being located at the end of said direct section;

an ion-electron emitting screen located on the path of said ions in said reverse section for secondary reflection of said ions towards said direction of propagation; and an ion detector located at the end of said reverse section and having ion detecting means for detecting positions of collision of said ions with said ion-electron emitting screen over time and space.

2. The mass spectrometer of claim 1, further comprising a magnetic mirror which is located at the end of said ion mass separation chamber and consists of a plurality of permanent magnets arranged circumferentially around said end of ion mass separation chamber and a permanent magnet at the end face of said ion mass separation chamber.

3. The mass spectrometer of claim 1, wherein said ion detector comprises at least one micro-channel plate.

4. The mass spectrometer of claim 3, wherein said ion detector is provided with position adjustment means for adjusting position of said detector in matched conditions of the most optimum performance.

5. The mass spectrometer of claim 1, wherein said electrostatic mirror means comprise at least one electrostatic mirror coaxial with said quadrupole electrostatic lenses and located after the last quadrupole electrostatic lens in said ion propagation direction.

6. The mass spectrometer of claim 5, wherein said at least one electrostatic mirror comprises a continuous ring with a positive potential applied from a first power source, said at least one electrostatic mirror being provided with a potential adjustment means.

7. The mass spectrometer of claim 6, further comprising a magnetic mirror which is located at the end of said ion mass separation chamber and consists of a plurality of permanent magnets arranged circumferentially around said end, of ion mass separation chamber and a permanent magnet at the end face of said ion mass separation chamber.

8. The mass spectrometer of claim 1, wherein said selected angle is equal to 360° divided by the number of quadrupole electrostatic lenses in said plurality.

9. The mass spectrometer of claim 8, further comprising: a first power source having a negative terminal, a positive terminal, and a midpoint between said negative terminal and said positive terminal; and a second power source having a negative terminal and a positive terminal; said first pair of two diametrically opposite poles being connected to said positive terminal of said first power source via a first resistor, said second pair of two diametrically opposite poles being connected to said negative terminal of said first power source, said midpoint of said first power source being connected to said negative terminal of said second power source via a second resistor, said positive terminal of said second power source being grounded, said second power source generating a current of a high voltage which is higher than voltage of said first power source; said high voltage decreasing from one quadrupole electrostatic lenses to another quadrupole electrostatic lenses in said direction of propagation.

10. The mass spectrometer of claim 9, wherein in said direct section radii of said helical trajectory gradually increase, and on said reverse section radii of said helical trajectory gradually decrease.

11. The mass spectrometer of claim 9, wherein each said quadrupole electrostatic lens is assembled from a first disk member and a second disk member which are identical, electrically isolated from each other, and are assembled in mirror positions with respect to each other, said first disk member having said first pair of two diametrically opposite poles, said second disk member having said second pair of two diametrically opposite poles, said first pair of diametrically opposite poles being angularly shifted with respect to said second pair of diametrically opposite poles by 90°.

12. The mass spectrometer of claim 9, wherein said electrostatic mirror means comprise at least one electrostatic mirror coaxial with said quadrupole electrostatic lenses and located after the last quadrupole electrostatic lens in said ion propagation direction.

13. The mass spectrometer of claim 12, wherein said at least one electrostatic mirror comprises a continuous ring with a positive potential applied from a first power source, said at least one electrostatic mirror being provided with a potential adjustment means.

14. The mass spectrometer of claim 13, further comprising a magnetic mirror which is located at the end of said ion mass separation chamber and consists of a plurality of permanent magnets arranged circumferentially around said end of ion mass separation chamber and a permanent magnet at the end face of said ion mass separation chamber.

15. The mass spectrometer of claim 11, wherein said first disk member has at least one pocket for accommodation of said first resistor, and wherein said second disk member has at least one pocket for accommodation of said second resistor.

16. The mass spectrometer of claim 11, wherein said ion detector comprises at least one micro-channel plate.

17. The mass spectrometer of claim 16, wherein said ion detector is provided with position adjustment means for adjusting position of said detector in match conditions of the most optimum performance.

18. The mass spectrometer of claim 11, further comprising a magnetic mirror which is located at the end of said ion mass separation chamber and consists of a plurality of permanent magnets arranged circumferentially around said end of ion mass separation chamber and a permanent magnet at the end face of said ion mass separation chamber.

19. The mass spectrometer of claim 11, wherein said electrostatic mirror means comprise at least one electrostatic mirror coaxial with said quadrupole electrostatic lenses and located after the last quadrupole electrostatic lens in said ion propagation direction.

20. The mass spectrometer of claim 19, wherein said at least one electrostatic mirror comprises a continuous ring with a positive potential applied from a first power source, said at least one electrostatic mirror being provided with a potential adjustment means.

21. The mass spectrometer of claim 20, further comprising a magnetic mirror which is located at the end of said ion mass separation chamber and consists of a plurality of permanent magnets arranged circumferentially around said end of ion mass separation chamber and a permanent magnet at the end face of said ion mass separation chamber.

* * * * *